US012578096B2

(12) United States Patent
Abascal Carrera et al.

(10) Patent No.: US 12,578,096 B2
(45) Date of Patent: Mar. 17, 2026

(54) CONTROL DEVICE FOR A COOKTOP, AND COOKTOP

(71) Applicant: BSH Hausgeräte GmbH, Munich (DE)

(72) Inventors: Luis Alberto Abascal Carrera, Camargo (ES); Roberto Carballo Fernandez, Santander (ES); Alvaro Martinez Diez, Peñacastillo (ES)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 18/843,739

(22) PCT Filed: Mar. 20, 2023

(86) PCT No.: PCT/EP2023/056994
§ 371 (c)(1),
(2) Date: Sep. 4, 2024

(87) PCT Pub. No.: WO2023/180221
PCT Pub. Date: Sep. 28, 2023

(65) Prior Publication Data

US 2025/0189138 A1 Jun. 12, 2025

(30) Foreign Application Priority Data

Mar. 21, 2022 (EP) ..... 22382261

(51) Int. Cl.
*F24C 3/12* (2006.01)

(52) U.S. Cl.
CPC ..... *F24C 3/124* (2013.01)

(58) Field of Classification Search
CPC ..... F24C 3/124; H01H 19/56; H01H 25/008
See application file for complete search history.

(56) References Cited

U.S. PATENT DOCUMENTS 6,100,480 A * 8/2000 Takahashi ..... H01H 25/00 200/11 R
7,242,390 B2 * 7/2007 Bader ..... H01H 25/002 345/184

(Continued)

FOREIGN PATENT DOCUMENTS

EP 1278111 B1 8/2005

OTHER PUBLICATIONS

International Search Report PCT/EP2023/056994 dated May 23, 2023.

*Primary Examiner* — Thomas C Diaz
(74) *Attorney, Agent, or Firm* — Michael E. Tschupp; Andre Pallapies; Brandon G. Braun

(57) ABSTRACT

A control device for a cooktop comprises a rotatable connection part including a coupling mechanism for coupling to a control shaft, an intermediate part; and a rotatable top part. The connection part and the intermediate part are slidably coupled to one another such that a rotation of the connection part is transmissible to the intermediate part, and that the connection part and the intermediate part are slidable relative to one another in a first radial direction. Further, the intermediate part and the top part are slidably coupled to one another such that a rotation of the intermediate part is transmissible to the top part, and that the intermediate part and the top part are slidable relative to one another in a second radial direction. The first and the second radial directions cross each other.

13 Claims, 3 Drawing Sheets

(56) References Cited

U.S. PATENT DOCUMENTS

| | | | | |
|---|---|---|---|---|
| 8,534,160 | B2 | 9/2013 | Giuliani | |
| 10,984,971 | B2 * | 4/2021 | Ueno | H01H 19/14 |
| 2019/0139723 | A1 | 5/2019 | Ueno | |

* cited by examiner

CONTROL DEVICE FOR A COOKTOP, AND COOKTOP

CROSS-REFERENCES TO RELATED APPLICATIONS

This application is the U.S. National Stage of International Application No. PCT/EP2023/056994, filed Mar. 20, 2023, which designated the United States and has been published as International Publication No. WO 2023/180221 A1 and which claims the priority of European Patent Application, Serial No. 22382261.0, filed Mar. 21, 2022, pursuant to 35 U.S.C. 119(a)-(d).

The contents of International Application No. PCT/EP2023/056994 and European Patent Application, Serial No. 22382261.0 are incorporated herein by reference in their entireties as if fully set forth herein.

BACKGROUND OF THE INVENTION

The present disclosure relates to a control device for a cooktop, such as a gas cooktop, and a cooktop. Manual control devices, for example, allow to set the power of a gas stove or oven by the user.

In household appliances, such as cooktops, often top plates separate the user area, such as heating elements or gas burners, and their associated control knobs or input devices from the usually below arranged technical facilities, such as electronics and/or gas tubing and valves. If, in particular, rotational control knobs are arranged on the top plate, openings need to be provided in order to mechanically couple the control knobs with control shafts, for example for a gas valves arranged below the top plate.

Sometimes, the circular openings in a cooktop and the respective control shafts are not always centered with each other, and a tolerance in the alignment of the rotational axis of the control knobs and the valve shafts, respectively, needs to be bridged. It is further desirable to keep the surface of the cooktop facing to the user relatively flat. Flat surfaces generally allow for an easier cleaning of the cooktop, e.g., from spilled liquids or particles.

BRIEF SUMMARY OF THE INVENTION

It is therefore an object of this disclosure to provide an improved control device for a cooktop, in particular for a gas cooktop having gas valves and control shafts to be operated.

According to an aspect of this disclosure, a control device for a cooktop is presented, wherein the control device comprises:

- a rotatable connection part including a coupling mechanism for coupling to a control shaft;
- an intermediate part; and
- a rotatable top part.

The connection part and the intermediate part are slidably coupled to one another such that a rotation of the connection part is transmissible to the intermediate part. Further, the connection part and the intermediate part are slidable relative to one another in a first radial direction.

Additionally, the intermediate part and the top part are slidably coupled to one another such that a rotation of the intermediate part is transmissible to the top part.

- Further, the intermediate part and the top part are slidable relative to one another in a second radial direction.
- The first and the second radial directions cross or intersect each other. In particular, the two radial directions are perpendicular to one another.

According to another aspect, a cooktop is provided, comprising a top plate having an opening, and a control device as disclosed above or below with respect to embodiments. The control device is inserted into the opening of the top plate.

The rotational connection part is, for example, adapted to couple to the control shaft through an opening in the top plate in a rotationally locked fashion. This allows to reliably operate and rotate the control shaft, such as a valve shaft for a gas valve, by transmitting a rotational force from a control knob to the shaft. For example, the control shaft reaches partially through the opening of the top plate and couples to the connection part, or the control device prolongs the shaft axis through the opening in the top plate.

The slidable couplings are, for example, implemented through a coupling mechanism.

In particular, the slidable couplings provide for a guided linear movement, translation or shift of the respective two coupled elements/components. A respective coupling may prevent a rotation of the coupled elements/components relative to each other.

Because the connection part and the intermediate part can slide against each other, for example, along a radius or diameter of the two parts, a tolerance or misalignment of the center of the hole or opening in the top plate and the axis of the control shaft can be bridged. Having slidable couplings with respect to a radial direction, in particular perpendicular to each other, an inclination and/or misalignment of the rotatable control shaft can be handled in a wide range.

One may appreciate that a control device for operating, e.g. with a control knob, a valve shaft through an opening in a top plate of a gas cooktop includes a mechanism for compensating a misalignment of the valve axis with respect to the top-plate opening. The mechanism comprises two slidable couplings between three components of the control device, i.e. the top, intermediate and connection part, and allows for a shift of the components in two directions in a plane perpendicular to the shaft and/or control knob axis.

In embodiments, the intermediate part is sandwiched between the top part and the connection part. Thus, the intermediate part may act as a coupling between the top and connection part allowing to relatively move the top part and the connection part in a plane perpendicular to the rotational axis of the control device.

As a slidable connection in two directions is obtained, automatically a transmission of the rotation is achieved. This is because the two sliding directions block a rotation along the same rotational axis of the top part, the connection part and the intermediate part. They all need to rotate in the same manner across the same axis.

In embodiments, the top part is cup-shaped, and at least partially accommodates the intermediate part and the connection part. For example, the cup comprises a shell circumferential wall and a cap or top wall. For example, the top wall can be used to couple a control knob with a further coupling mechanism in a rotational locked manner to the top part.

In embodiments, the intermediate part and the connection part are ring-shaped and coupled with each other through a first coupling mechanism that includes two radially extending guide tracks along the first radial direction and two corresponding radially extending slide elements. The slide elements, for example, correspond geometrically to the guide tracks, respectively, and can be accommodated within the guide tracks. In a preferred embodiment, the slide elements can be inserted within the guide tracks allowing a linear movement but cannot be separated. Thus, a linear translation or movement, for example across a diameter of both ring-shaped parts, the connection and the intermediate part, is feasible. Hence, the connection part and the intermediate part can be shifted with respect to each other, thereby bridging a tolerance in a potential misalignment of the control shaft and a fixed opening in the top plate.

Likewise, in embodiments, the top part and the intermediate part are coupled with each other through a second coupling mechanism that includes two radially extending guide tracks among the second radial direction and two corresponding radially extending slide elements. The radial directions are preferably perpendicular to one another. The radial directions are preferably perpendicular to one another. As in the coupling of the connection part and intermediate part, the slide elements of the top part can be inserted within the guide tracks of the intermediate part allowing a linear movement between parts but they cannot be separated. In both cases, inserted means that the coupling between slide elements and guide tracks maintains both parts together but with relative linear movement between them.

In embodiments, the control device has a rotational symmetry with respect to the rotational axis of the shaft and/or the top part. The guide tracks have an elongated form for accommodating slide elements, such that a loose form-fit can be realized. Generally, it is irrelevant at or in what part the guide tracks are implemented, if the attached part carries corresponding slide elements.

In embodiments, the intermediate part has a first side and a second side and comprises a first pair of guide tracks for corresponding slide elements at the first side and a second pair of guide tracks for corresponding slide elements at the second side. The first and the second pair of guide tracks are preferably perpendicular to another.

The intermediate part can be seen as a coupling piece between the connection part fixedly coupled to the control shaft and the top part that provides for a user interaction, for example, with an additional control knob coupled to the top part.

In embodiments, the connection part and the intermediate part are concentrically arranged about a rotational axis of the top part or the control device itself.

In embodiments of the control device, the device further comprises a bottom part having an opening for the shaft and a circumferential wall at least partially enclosing the intermediate part coupled to the connection part.

In embodiments, the guide tracks and slide element extend in direction perpendicular to an axis of the control shaft.

The bottom can be used as a housing having cylindrical form. Together with a top part, the entire control device achieves a cylindrical shape that is suitable to be inserted into an opening and a top plate.

In embodiments, further a sleeve part enclosing the top part is comprised in the control device, wherein the sleeve part is coupled to the bottom part. For example, the top part and the bottom part may confine the interior parts, i.e., the connection part and the intermediate part.

In particular, the sleeve part can have a shoulder that abuts to the edge of the opening in the top plate when the control device is inserted. The sleeve part and the bottom part may be mechanically coupled to each other, for example by a snap-fit, bajonet coupling, screw connection, or other means for coupling.

In embodiments, where the guide tracks and slide elements are not inserted and separable, the control device comprises a spring element arranged between an inner rim of the bottom part and the connection part for pressing the connection part axially towards the top part. The spring can surround the valve shaft and flexibly fix the connection and intermediate part within the housing, e.g., realized by the sleeve part, the top part and the bottom part. Moreover, the spring forces the top part pressed towards the sleeve part with the collar of the top part pressed towards the sleeve section limiting its movement.

In embodiments, an outer radial extension of the connection part is smaller than an inner radial extension of the top part. This can lead to a gap between the connection part and an inner circumferential wall of the top part. Hence, preferably, the intermediate part and the connection part can laterally move within the inner circumferential walls of the top and/or the bottom part.

In embodiments, the control device further comprises a coupling device for coupling with a control knob in a rotationally locked fashion, e.g., at an upper surface of the top part. A coupling can be obtained, for example, by a magnetic coupling, a snap-fit, form-fit, or additional means for coupling the control knob with the coupling device.

In embodiments of a cooktop, the control device is implemented having a bottom part with an opening for the shaft and the circumferential wall at least partially enclosing the intermediate part coupled to the connection part, and a sleeve part enclosing the top part, wherein the sleeve part is coupled to the bottom part and comprises a radially outward extending shoulder. The shoulder abuts on the top surface of the top plate. According to this embodiment, a relatively flat surface above the top plate is achieved so that cleaning of the cooktop is facilitated.

Further possible implementations or alternative solutions of the invention also encompass combinations—that are not explicitly mentioned herein—of features described above or below with regard to the embodiments. The person skilled in the art may also add individual or isolated aspects and features to the most basic form of the invention.

BRIEF DESCRIPTION OF THE DRAWINGS

Further embodiments, features and advantages of the present invention will become apparent from the subsequent description and dependent claims, taken in conjunction with the accompanying drawings, in which:

DETAILED DESCRIPTION OF EXEMPLARY EMBODIMENTS OF THE PRESENT INVENTION

Figure 1:
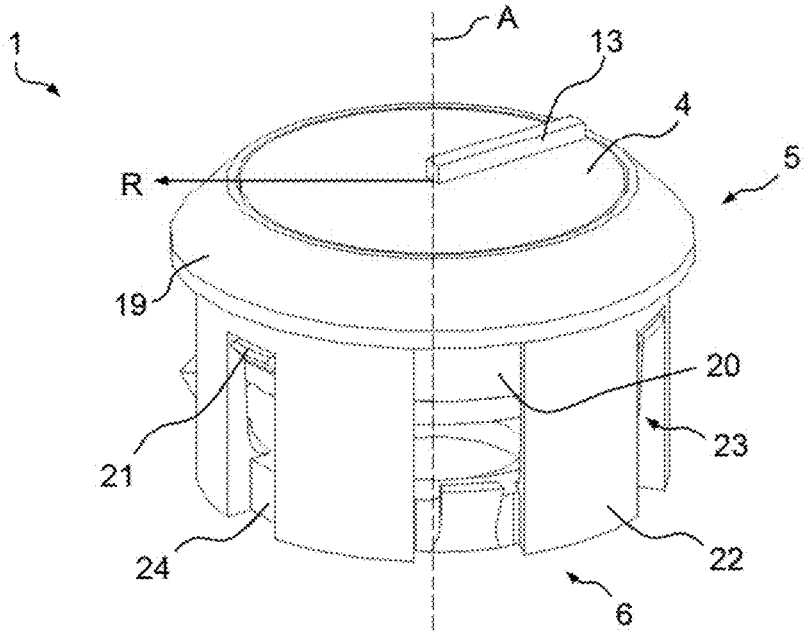
FIG. 1 shows a first perspective view of an embodiment for a control device.

In the Figures, like reference numerals designate like or functionally equivalent elements, unless otherwise indicated.

In the following, an embodiment of a control device and the cooktop including the control device is explained with respect to FIGS. 1-6.

The control device 1 as shown in FIG. 1 has a cylindrical form and includes a rotatable top part 4 with an index 13 which can be rotated along the axis A. The top part 4 is inserted in a sleeve part 5 having a shoulder or apron 19.

The sleeve part 5 has a ring shape and is coupled to a bottom part 6 having a cylindrical shape with a circumferential sidewall 22 interrupted by slits 23 along the axial direction A. The slits 23 act as a groove into which a latch or catcher 21 can engage. Thus, the sleeve part 5 and the bottom part 6 are coupled in terms of a snap-fit and provide for an interior for accommodating an intermediate part 3 and a connection part 2 which are both ring-shaped (see FIG. 3).

Figure 3:
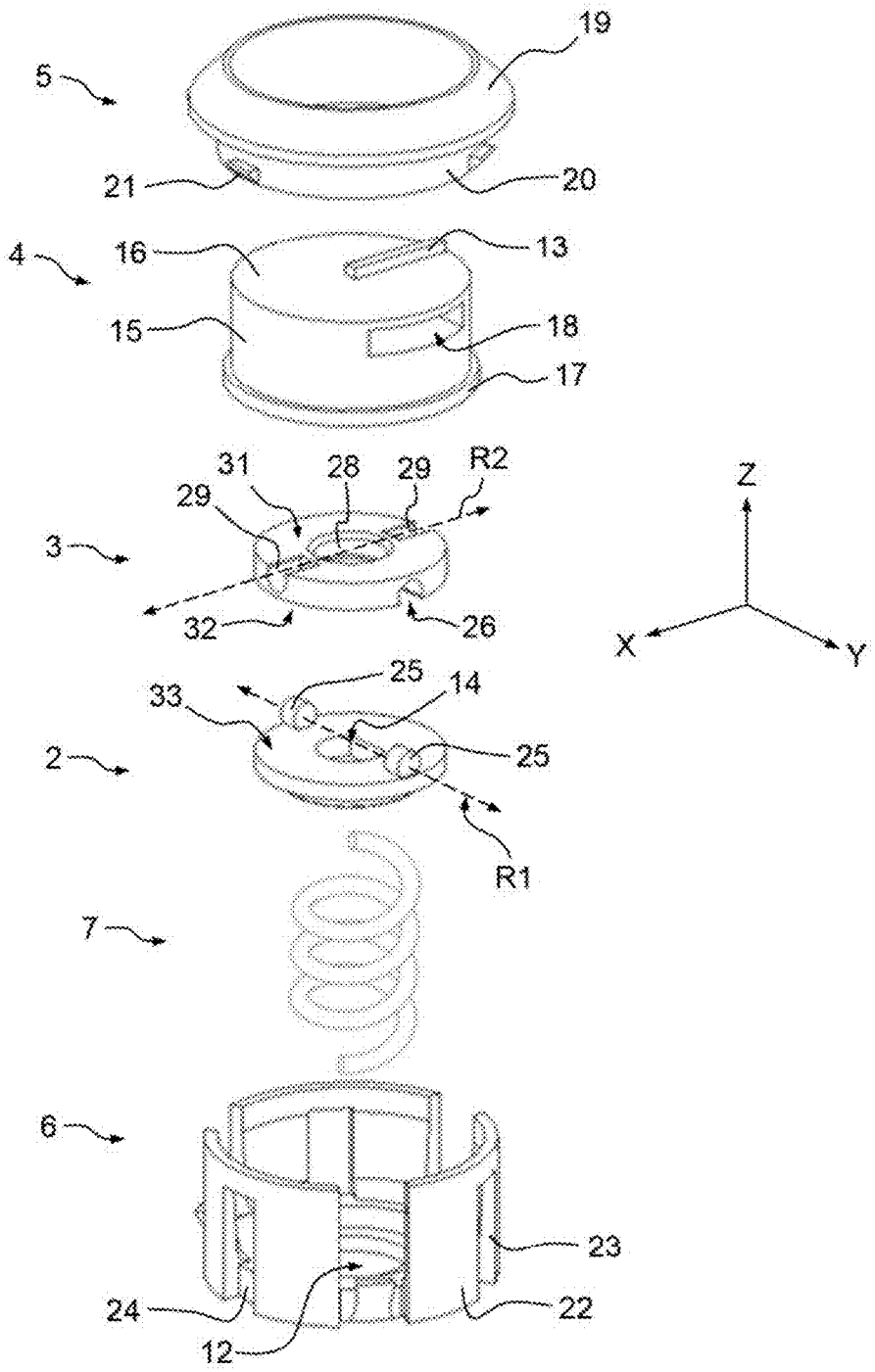
FIG. 3 shows an exploded view of the embodiment for a control device.

The exploded view of FIG. 3 illustrates the components of the control device 1 independently along the axis A. The sleeve part 5 has a downwardly protruding circumferential sleeve section 20 with engagement hooks 21 extending radially outward. The engagement hooks 21 fit into the slits, grooves or gaps 23 in the circumferential wall 22 of the bottom part 6. The index 13 at the top surface or cap wall 16 of the cup-like top part 4 is a radially extending ridge or fin and allows to exercise a rotational force so that the top part 4 can be rotated.

Figure 2:
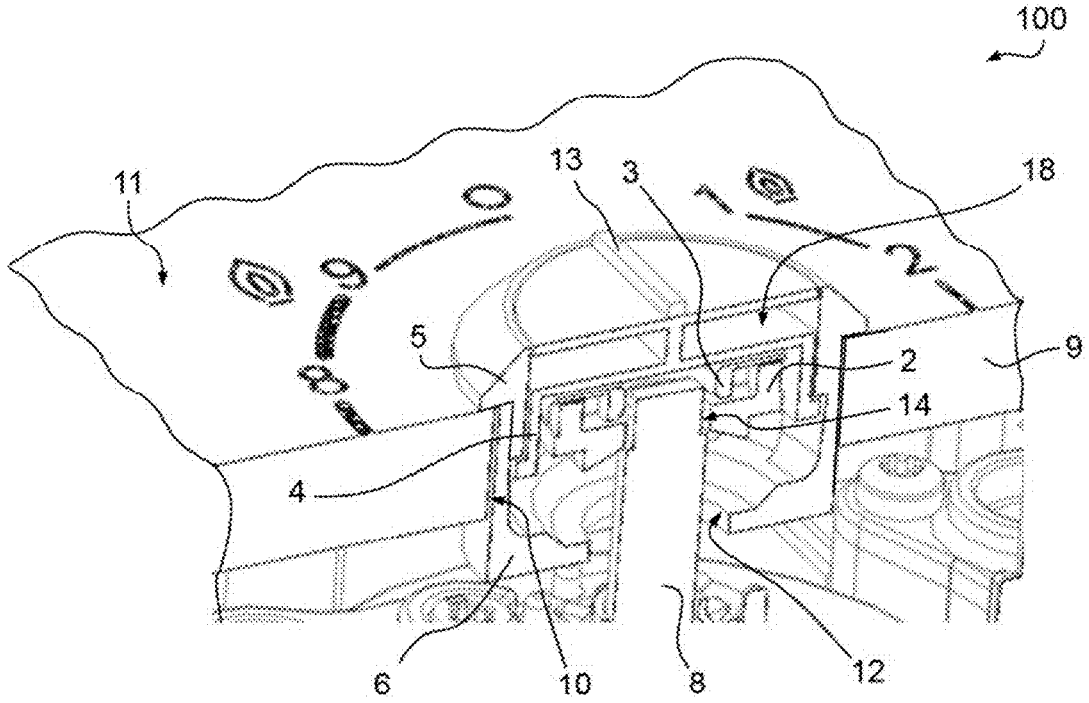
FIG. 2 shows a truncated perspective view of a cooktop with the embodiment for a control device.

In particular, the cylindrical shape of the control device 1 is suitable to be inserted into an opening of a top plate in a cooktop. FIG. 2 shows an example for a cooktop 100 with a top plate having an opening 10 towards which a control shaft 8 extends from below. The control shaft 8 is, for example, a valve shaft of a gas valve arranged below the top plate 9. In the truncated view, the control device 1 is shown in a cross-section along its diameter perpendicular to the inner edge of the index 13. On the top surface 11 of the top plate 9, a scale is printed to indicate a power of the associated gas burner. The rotational position of the control shaft 8 corresponds to a gas flow or power of the associated gas burner in the cooktop 100. In the interior of the control device 1, an arrangement of, for example, two components is placed that allows to transmit a rotational force from the top part 4 to the valve shaft 8. Further, there is a mechanism to center and equal out tolerances in the potentially eccentric position of the control shaft 8 with respect to the opening 10.

FIG. 3 is an exploded view of the components of the control device 1 shown in an assembled state in FIG. 1. Along its axial extension from top to bottom in the orientation of FIG. 3, the essentially circular elements: sleeve part 5, top part 4 and bottom part 6 are put together so that the top part 4 reaches through a downward protruding inner circumferential wall 20 of the sleeve part 5, wherein the circumferential wall 15 of the cup-shaped top part 4 is enclosed by the sleeve part 5.

Within the cup-shaped top part 4, i.e., within the circumferential wall 15, an intermediate part 3 and a connection part 2 is held. A spring element 7 presses the connection part 2 and the intermediate part 3 upwards against the inner wall of the cap 16 of the top part 4. Moreover, the spring 7 forces the top part 4 pressed towards the sleeve part 5 with the collar 17 of the top part pressed towards the sleeve section 20 limiting its movement in Z positive.

FIG. 3 shows coordinates X, Y, Z, wherein the z-axis corresponds to the rotational axis A as indicated in FIG. 1. In a mounted state, in a cooktop 100, as shown in FIG. 2, the drive shaft 8 (omitted in FIG. 3) reaches through the opening 12 into the bottom part 6, and is surrounded by the spring element 7. The shaft 8 is fixedly coupled to the connection part 2 having a specifically shaped opening 14. To this end, the opening 14 has an irregular cross-section corresponding the upper part of the shaft 8. The opening 14 has a non-circular cross-section, thus allowing for a coupling in a rotationally locked fashion with respect to the shaft 8.

Attached to the connection part 2 is an intermediate part 3, wherein the top surface 33 of the connection part 2 and the bottom surface 32 of the intermediate part 3 are slidably attached to each other, so that a relative linear movement is possible. A combination of slide elements 25 and guide tracks 22 provide for a coupling between the connection and intermediate part 2, 3, wherein a shift along a first radial direction R1 is possible. The radial direction R1 corresponds to the Y-direction in FIG. 3. The shape of the slide element 25 and the guide track 22 correspond with each other so that there is a loose form-fit.

Similarly, the intermediate part 3 comprises linear guide tracks 29 on its top surface 31. The linear guide tracks 29 correspond to further slide 30 elements arranged within the interior of the top part 4 (see FIG. 6).

As can be seen in FIG. 3, the cup-shaped top part 4 has an opening 18 in its circumferential wall 15 that leads into a compartment 18 or receptacle, for example for magnets. This can be seen in FIG. 2 where there is a compartment or receptacle 18 below the cap wall 16. For example, magnets can be used to magnetically couple with a control knob attached to the cap surface 16 with the index 13. The—not shown—control knob then includes magnets for coupling with the top part 4 and a groove corresponding to the index 13, so that a rotational force can be transmitted.

In particular, the combination of linear guide tracks and sliding elements arranged at the connection part 2, the intermediate part 3 and within the top part 4 allow for a compensation of a misalignment of the control shaft 8 with respect to the center axis A of the opening 10 in the top plate 9 (see FIG. 2). The coupling mechanisms allow for a radial displacement in X-direction or direction R2, respectively, and in the Y-direction or radial direction R1, respectively.

Figure 4:
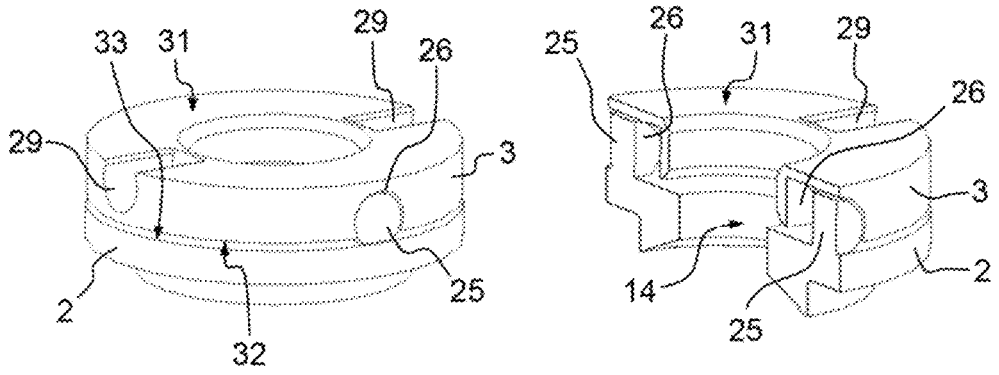
FIGS. 4-6 show perspective and truncated views of components of the embodiment for a control device.
Figure 5:
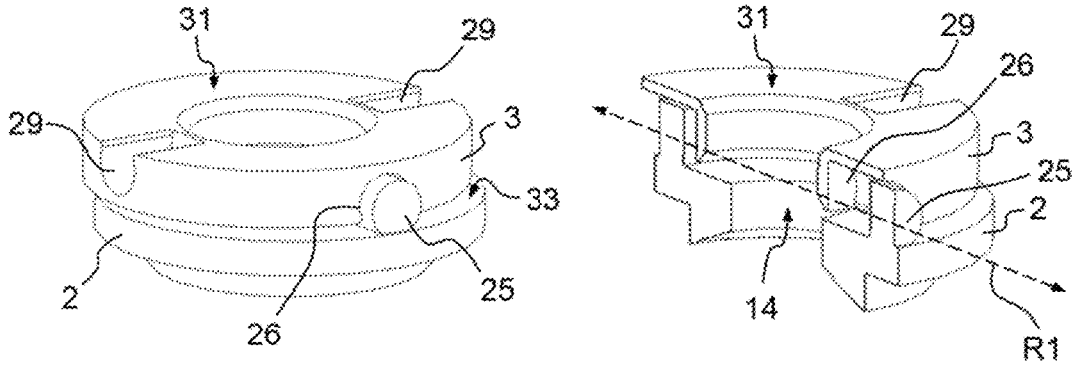
Figure 6:
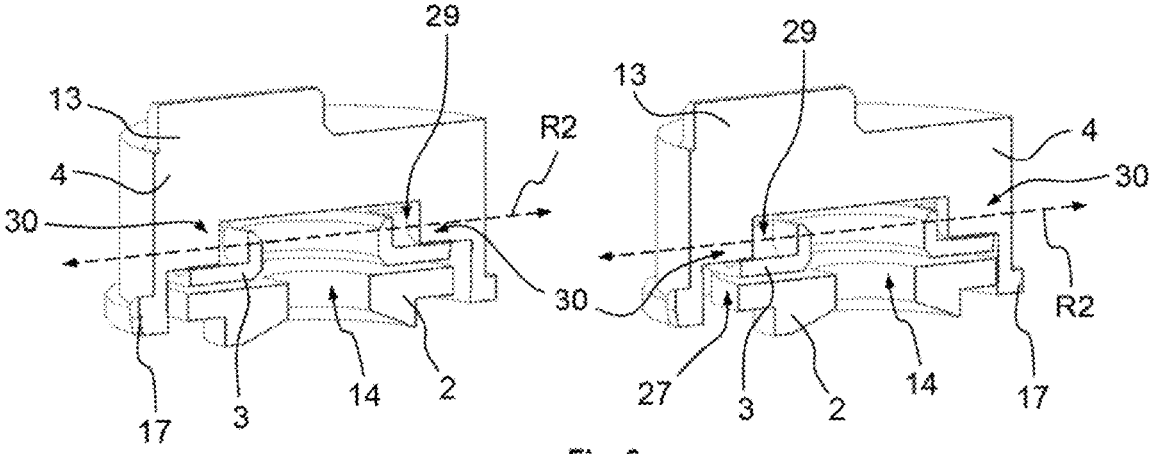

FIGS. 4-6 further illustrate the radial movements along the linear guide tracks. FIG. 4 shows two ring-shaped components, the connection part 2 attached to the intermediate part 3 and a perspective view (left) and a truncated view (right). In FIG. 4, the rings of the connection part 2 and the intermediate part 3 are in a concentric position with respect to the rotational axis. At the top surface 32 of the connection part 2, tube-shaped guide elements 25 run across a diameter along radial direction R1 (see FIG. 3). The tube-shaped slide elements 25 are accommodated in linear guide tracks 26 that are implemented in the lower surface 32 of the intermediate part 3.

In FIG. 5 a displacement in the negative Y-direction of the connection part 2 and the intermediate part 3 relative to one another is illustrated. Due to the linear guide mechanism, the two components 2, 3 are shifted along direction R1 at the respective surfaces 32 and 33. Hence, the coupling between the connection part 2 and the intermediate part 3 allows for a tolerance in a first direction perpendicular to the rotational axis A.

In order to span a plane, a second displacement direction is implemented. This is shown in FIG. 6. The upper surface 31 of the intermediate part 3 comprises channels or guide tracks 29 that are implemented to receive slide elements 30 extending radially inward from the inner side of the circumferential wall 15 of the top part 4. In FIG. 6, the second displacement direction R2, which is perpendicular to the direction R1, is indicated by the double arrow.

On the left-hand side of FIG. 6, all elements, i.e., the connection part 2, the intermediate part 3 and the top part 4, are concentrically arranged. The right-hand side of FIG. 6 shows a displacement of the intermediate part 3 towards the right in the orientation of FIG. 6. The displacement is limited by the size of the gap 27 between the outer radial extension of the ring-shaped intermediate part 3 and the respective inner diameter of the top part 4.

Hence, both linear displacement mechanisms realized by a combination of corresponding guide tracks and slide elements provide for a movement of the opening 14 that corresponds to the actual position of the control shaft 8, that can be placed eccentrically, thereby compensating for a misalignment of the control shaft 8 with respect to the opening 10 or the outer circumferential walls of the control device 1.

Although the present invention has been described in accordance with preferred embodiments, it is obvious for the person skilled in the art that modifications are possible in all embodiments. It is understood that, in the disclosed embodiments, the shape and combinations of the guide tracks and the slide elements can be exchanged. For example, one can contemplate of an intermediate part that has ribs, ridges, fins or other elongated protrusions at its top and bottom surface. Correspondingly, then the top part and the connection part will have appropriate guide tracks that allow for a movement in the plane perpendicular to the rotational axis of the control device.

The invention claimed is:

1. A control device for a cooktop, the control device comprising:

a rotatable connection part coupled to a control shaft;

an intermediate part;

a rotatable top part;

a bottom part having an opening which receives the shaft; and a circumferential wall which at least partially encloses the intermediate part that is coupled to the connection part;

wherein the connection part and the intermediate part are slidably coupled to one another such that a rotation of the connection part is transmissible to the intermediate part, and that the connection part and the intermediate part are slidable relative to one another in a first radial direction;

wherein the intermediate part and the top part are slidably coupled to one another such that a rotation of the intermediate part is transmissible to the top part, and that the intermediate part and the top part are slidable relative to one another in a second radial direction; and wherein the first and the second radial directions cross each other.

2. The control device of claim 1, wherein the intermediate part is sandwiched between the top part and the connection part.

3. The control device of claim 1, wherein the top part is cup-shaped and designed to at least partially accommodate the intermediate part and the connection part.

4. The control device of claim 1, wherein the connection part and the intermediate part are ring-shaped, the control device further comprising a first coupling mechanism designed to couple the connection part and the intermediate part with each other and including two radially extending guide tracks along the first radial direction and two corresponding radially extending slide elements accommodated in the guide tracks.

5. The control device of claim 1, further comprising a second coupling mechanism designed to couple the top part and the intermediate part with each other and including two radially extending guide tracks along the second radial direction and two corresponding radially extending slide elements received in the guide tracks.

6. The control device of claim 1, wherein the intermediate part has a first side and a second side, the intermediate part comprising a first pair of guide tracks for receiving corresponding slide elements at the first side and a second pair of guide tracks for receiving corresponding slide elements at the second side, the first pair of guide tracks and the second pair of guide tracks being perpendicular to each other.

7. The control device of claim 1, wherein the connection part and intermediate part are concentrically arranged about a rotational axis of the top part.

8. The control device of claim 1, further comprising a sleeve part designed to enclose the top part and coupled to the bottom part.

9. The control device of claim 8, further comprising a spring element arranged between an inner rim of the bottom part and the connection part for pressing the connection part axially towards the top part.

10. The control device of claim 1, wherein the connection part has an outer radial extension which is smaller than an inner radial extension of the top part so as to form a gap between the connection part and an inner circumferential wall of the top part.

11. The control device of claim 1, wherein the top part comprises a coupling device for coupling with a control knob in a rotationally locked fashion.

12. A cooktop, comprising:

a top plate having an opening, a control device inserted into the opening of the top plate and comprising a rotatable connection part coupled to a control shaft, an intermediate part, and a rotatable top part, wherein the connection part and the intermediate part are slidably coupled to one another such that a rotation of the connection part is transmissible to the intermediate part, and that the connection part and the intermediate part are slidable relative to one another in a first radial direction, wherein the intermediate part and the top part are slidably coupled to one another such that a rotation of the intermediate part is transmissible to the top part, and that the intermediate part and the top part are slidable relative to one another in a second radial direction, and wherein the first and the second radial directions cross each other;

a bottom part having an opening for receiving the control shaft and a circumferential wall at least partially enclosing the intermediate part that is coupled to the connection part; and a sleeve part designed to enclose the top part and coupled to the bottom part, the sleeve part comprising a radially outward extending shoulder abutting on a top surface of the top plate.

13. The cooktop of claim 12, further comprising a control shaft reaching into the opening and being coupled to the connection part in a rotationally locked fashion.

* * * * *